US009877629B2

(12) United States Patent
Reindle et al.

(10) Patent No.: US 9,877,629 B2
(45) Date of Patent: Jan. 30, 2018

(54) BATTERY-POWERED CORDLESS CLEANING SYSTEM

(71) Applicant: TECHTRONIC INDUSTRIES CO. LTD., Tsuen Wan, New Territories (HK)

(72) Inventors: Mark Reindle, Sagamore Hills, OH (US); Brett Reed, Alliance, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 51 days.

(21) Appl. No.: 14/175,421

(22) Filed: Feb. 7, 2014

(65) Prior Publication Data

US 2014/0223688 A1 Aug. 14, 2014

Related U.S. Application Data

(60) Provisional application No. 61/762,691, filed on Feb. 8, 2013.

(51) Int. Cl.
*A47L 5/00* (2006.01)
*A47L 7/00* (2006.01)
(Continued)

(52) U.S. Cl.
CPC ..... *A47L 9/2884* (2013.01); *A47L 9/0477* (2013.01); *A47L 9/2847* (2013.01); *A47L 9/2857* (2013.01); *A47L 9/2894* (2013.01)

(58) Field of Classification Search
CPC ..... A47L 9/28–9/2894
(Continued)

(56) References Cited

U.S. PATENT DOCUMENTS 3,743,911 A 7/1973 Erler
4,536,688 A 8/1985 Roger
(Continued)

FOREIGN PATENT DOCUMENTS

CN 1764409 4/2006
CN 102834037 12/2012
(Continued)

OTHER PUBLICATIONS

International Search Report and Written Opinion for Application No. PCT/US2014/015328 dated May 27, 2014 (9 pages).

*Primary Examiner* — Bryan R Muller
(74) *Attorney, Agent, or Firm* — Michael Best & Friedrich LLP

(57) ABSTRACT

A cleaning system comprising a rotor; an agitator; a rechargeable battery having a housing and at least two cells within the housing; a suction motor receiving power from the rechargeable battery, the suction motor coupled to the rotor; a brush motor receiving power from the rechargeable battery, the brush motor coupled to the agitator; a user-controlled switch configured to generate a user-activated signal in response to user manipulation; and a controller. The controller configured to output a first pulse-width modulated signal at a first duty cycle to control the suction motor, output a second pulse-width modulated signal at a second duty cycle to control the brush motor at a first speed, receive the user-activated signal, and upon receiving the user-activated signal, output the second pulse-width modulated signal at a third duty cycle to control the brush motor at a second speed.

19 Claims, 8 Drawing Sheets

(51) Int. Cl.
*A47L 9/28* (2006.01)
*A47L 9/04* (2006.01)

(58) Field of Classification Search
USPC ..... 15/339, 319
See application file for complete search history.

(56) References Cited

U.S. PATENT DOCUMENTS

| | | | | |
|---|---|---|---|---|
| 4,827,550 | A | 5/1989 | Graham et al. | |
| 4,873,453 | A | 10/1989 | Schmerda et al. | |
| 5,045,920 | A | 9/1991 | Vig et al. | |
| 5,264,766 | A | 11/1993 | Tracht et al. | |
| 5,264,783 | A | 11/1993 | Vig et al. | |
| 5,389,889 | A | 2/1995 | Towne et al. | |
| 5,442,283 | A | 8/1995 | Vig et al. | |
| 5,517,112 | A | 5/1996 | Vig et al. | |
| 5,545,112 | A | 8/1996 | Densmore et al. | |
| 5,563,482 | A | 10/1996 | Shaw et al. | |
| 5,581,179 | A | 12/1996 | Engel et al. | |
| 5,619,137 | A | 4/1997 | Vig et al. | |
| 5,621,319 | A | 4/1997 | Bilotti et al. | |
| 5,650,719 | A | 7/1997 | Moody et al. | |
| 5,686,894 | A | 11/1997 | Vig et al. | |
| 5,694,038 | A | 12/1997 | Moody et al. | |
| 5,708,578 | A | 1/1998 | Stoddard et al. | |
| 5,729,130 | A | 3/1998 | Moody et al. | |
| 5,734,243 | A | 3/1998 | Pabla et al. | |
| 5,738,177 | A | 4/1998 | Schell et al. | |
| 5,856,736 | A | 1/1999 | Rotunda et al. | |
| 5,859,509 | A | 1/1999 | Bienz et al. | |
| 5,892,349 | A | 4/1999 | Bogwicz et al. | |
| 5,917,320 | A | 6/1999 | Scheller et al. | |
| 5,936,364 | A | 8/1999 | Ohsawa et al. | |
| 6,058,561 | A | 5/2000 | Song et al. | |
| 6,181,092 | B1 | 1/2001 | Turner | |
| 6,466,390 | B1 | 10/2002 | Watanabe | |
| 6,523,630 | B2 | 2/2003 | Sim | |
| 6,563,284 | B2 | 5/2003 | Teutsch et al. | |
| 6,605,156 | B1 | 8/2003 | Clark et al. | |
| 6,664,748 | B2 | 12/2003 | Kushida et al. | |
| 6,750,622 | B2 | 6/2004 | Simizu et al. | |
| 6,759,822 | B2 | 7/2004 | Marusarz | |
| 6,801,009 | B2 | 10/2004 | Makaran et al. | |
| 6,819,069 | B2 | 11/2004 | Hornberger et al. | |
| 7,030,584 | B1 | 4/2006 | Alberkrack | |
| 7,064,510 | B2 | 6/2006 | Brannen et al. | |
| 7,079,923 | B2 * | 7/2006 | Abramson | F04D 29/30 180/167 |
| 7,086,483 | B2 | 8/2006 | Arimura et al. | |
| 7,148,642 | B2 | 12/2006 | Brannen et al. | |
| 7,208,892 | B2 | 4/2007 | Tondra et al. | |
| 7,237,298 | B2 | 7/2007 | Reindle et al. | |
| 7,237,299 | B2 | 7/2007 | Tondra et al. | |
| 7,247,076 | B2 | 7/2007 | Dang et al. | |
| 7,276,867 | B2 | 10/2007 | Alberkrack et al. | |
| 7,391,630 | B2 | 6/2008 | Acatrinei | |
| 7,424,766 | B2 | 9/2008 | Reindle et al. | |
| 7,590,334 | B2 | 9/2009 | Yabusaki et al. | |
| 7,599,758 | B2 | 10/2009 | Reindle et al. | |
| 7,717,192 | B2 | 5/2010 | Schroeder et al. | |
| 7,725,223 | B2 | 5/2010 | Gordon et al. | |
| 7,798,245 | B2 | 9/2010 | Trautner | |
| 7,800,328 | B2 | 9/2010 | Hayashi | |
| 7,834,565 | B2 | 11/2010 | Armstrong | |
| 7,847,511 | B2 | 12/2010 | Yoo et al. | |
| 7,882,899 | B2 | 2/2011 | Borinato et al. | |
| 7,932,688 | B2 | 4/2011 | Han et al. | |
| 8,099,825 | B2 | 1/2012 | Zahuranec et al. | |
| 8,166,701 | B1 | 5/2012 | Duff, Sr. | |
| 8,172,642 | B2 | 5/2012 | King et al. | |
| 8,179,069 | B2 | 5/2012 | Matsunaga et al. | |
| 8,350,508 | B2 | 1/2013 | Celik | |
| 8,373,378 | B2 | 2/2013 | Steiner | |
| 8,436,267 | B2 | 5/2013 | Staas et al. | |
| 2006/0208821 | A1 | 9/2006 | Alberkrack | |
| 2009/0101379 | A1 | 4/2009 | Du et al. | |
| 2010/0045215 | A1 | 2/2010 | Hawker et al. | |
| 2010/0088843 | A1 * | 4/2010 | Reed | A47L 9/2857 15/389 |
| 2010/0200380 | A1 | 8/2010 | Staas et al. | |
| 2010/0237831 | A1 | 9/2010 | Osswald et al. | |
| 2010/0253250 | A1 | 10/2010 | Marvelly et al. | |
| 2011/0181226 | A1 | 7/2011 | Steiner | |
| 2011/0197389 | A1 | 8/2011 | Ota et al. | |
| 2011/0284255 | A1 | 11/2011 | Ookubo et al. | |
| 2011/0299247 | A1 | 12/2011 | Zhang et al. | |
| 2012/0081064 | A1 | 4/2012 | Leaver et al. | |
| 2012/0112670 | A1 * | 5/2012 | Danestad | A47L 9/2831 318/139 |
| 2012/0317743 | A1 | 12/2012 | Reed et al. | |
| 2013/0198995 | A1 * | 8/2013 | Eriksson | A47L 9/0477 15/383 |
| 2014/0013540 | A1 | 1/2014 | Erko et al. | |
| 2014/0366286 | A1 | 12/2014 | Zheng et al. | |

FOREIGN PATENT DOCUMENTS

| | | | | |
|---|---|---|---|---|
| EP | 0252898 | | 1/1988 | |
| EP | 252898 | A2 * | 1/1988 | |
| EP | 0252898 | A2 * | 1/1988 | H02M 7/53873 |
| EP | 1955634 | | 8/2008 | |
| EP | 1955634 | A2 * | 8/2008 | A47L 9/0477 |
| WO | WO 2000/38028 | | 6/2000 | |

* cited by examiner

BATTERY-POWERED CORDLESS CLEANING SYSTEM

RELATED APPLICATIONS

The present application claims priority to U.S. Provisional Application 61/762,691, filed Feb. 8, 2013, the entire content of which is hereby incorporated.

BACKGROUND

The present invention relates to consumer devices, such as suction force cleaners (e.g., vacuum cleaners).

SUMMARY

Cleaning systems include a wide range of products designed to meet a wide variety of cleaning needs. Examples of cleaning systems include stick-type vacuums, lightweight upright vacuums, hand-held vacuums, carpet cleaners, canister vacuums, etc.

Some cleaning systems utilize a brush motor coupled to an agitator, such as a brush, along with a suction motor coupled to a rotor, such as an impeller or fan, for removal of debris. Commonly, the brush motor rotates the brush to agitate the cleaning surface. As the brush motor rotates the brush, the suction motor rotates the rotor to gather the debris exposed by the agitator.

The agitator operating at a high speed on hard cleaning surfaces, such as hard wood floors, can scatter the debris away from the cleaning system before the debris is gathered by the rotation of the rotor. Therefore, it is common for a cleaning system to turn the brush motor off while cleaning hard surfaces. However, turning the brush motor off inhibits cleaning of the surface and reduces the efficiency of the cleaning system. A different alternative is desired.

In one embodiment, the invention provides a cleaning system comprising a rotor; an agitator; a rechargeable battery having a housing and at least two cells within the housing; a suction motor receiving power from the rechargeable battery, the suction motor coupled to the rotor; a brush motor receiving power from the rechargeable battery, the brush motor coupled to the agitator; a user-controlled switch configured to generate a user-activated signal in response to user manipulation; and a controller. The controller configured to output a first pulse-width modulated signal at a first duty cycle to control the suction motor, output a second pulse-width modulated signal at a second duty cycle to control the brush motor at a first speed, receive the user-activated signal, and upon receiving the user-activated signal, output the second pulse-width modulated signal at a third duty cycle to control the brush motor at a second speed.

In another embodiment the invention provides a method for operating a cleaning system, the cleaning system including a rotor, an agitator, a rechargeable battery, a suction motor coupled to the rotor, a brush motor coupled to the agitator, a user-controlled switch, and a controller. The method comprising calculating a voltage of the rechargeable battery; outputting a first pulse-width modulated signal at a first duty cycle to control the suction motor; outputting a second pulse-width modulated signal at a second duty cycle to control the brush motor at a first speed; receiving a user-activated signal from the user-controlled switch; and upon receiving the user-activated signal, outputting the second pulse-width modulated signal at a third duty cycle to control the brush motor at a second speed.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
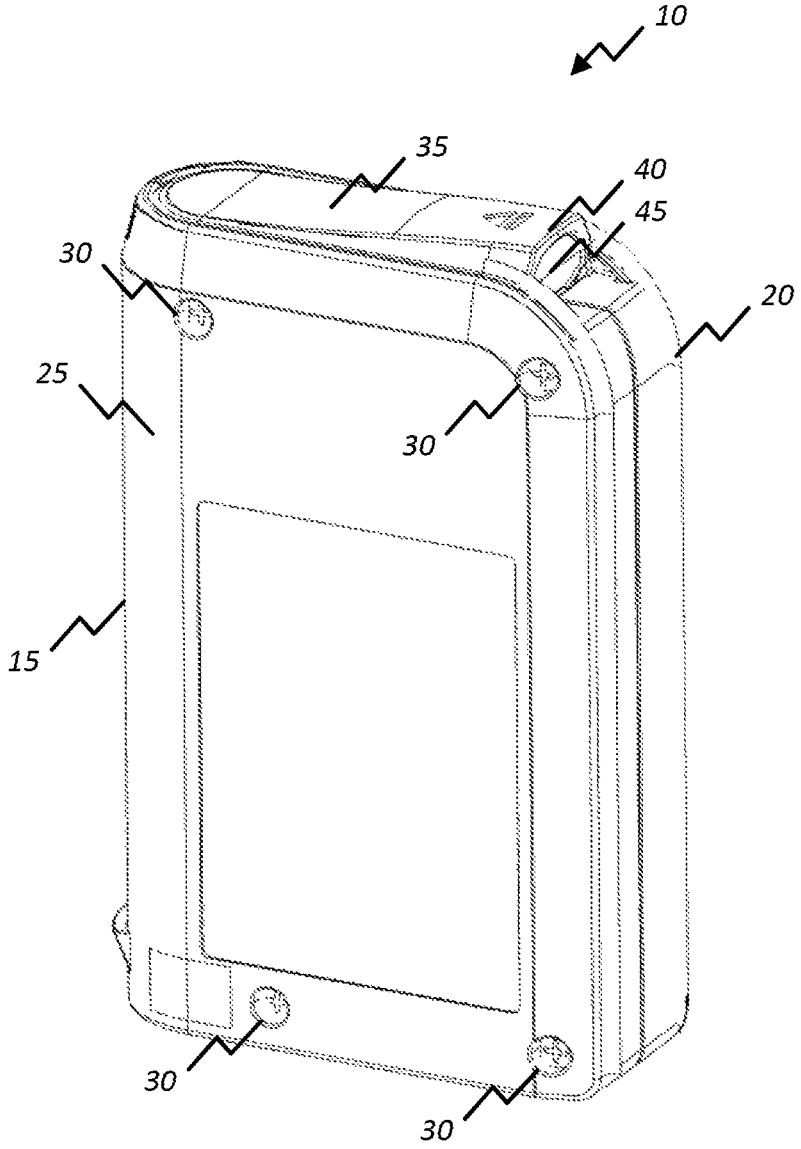
FIG. 1 illustrates a battery pack.
Figure 2:
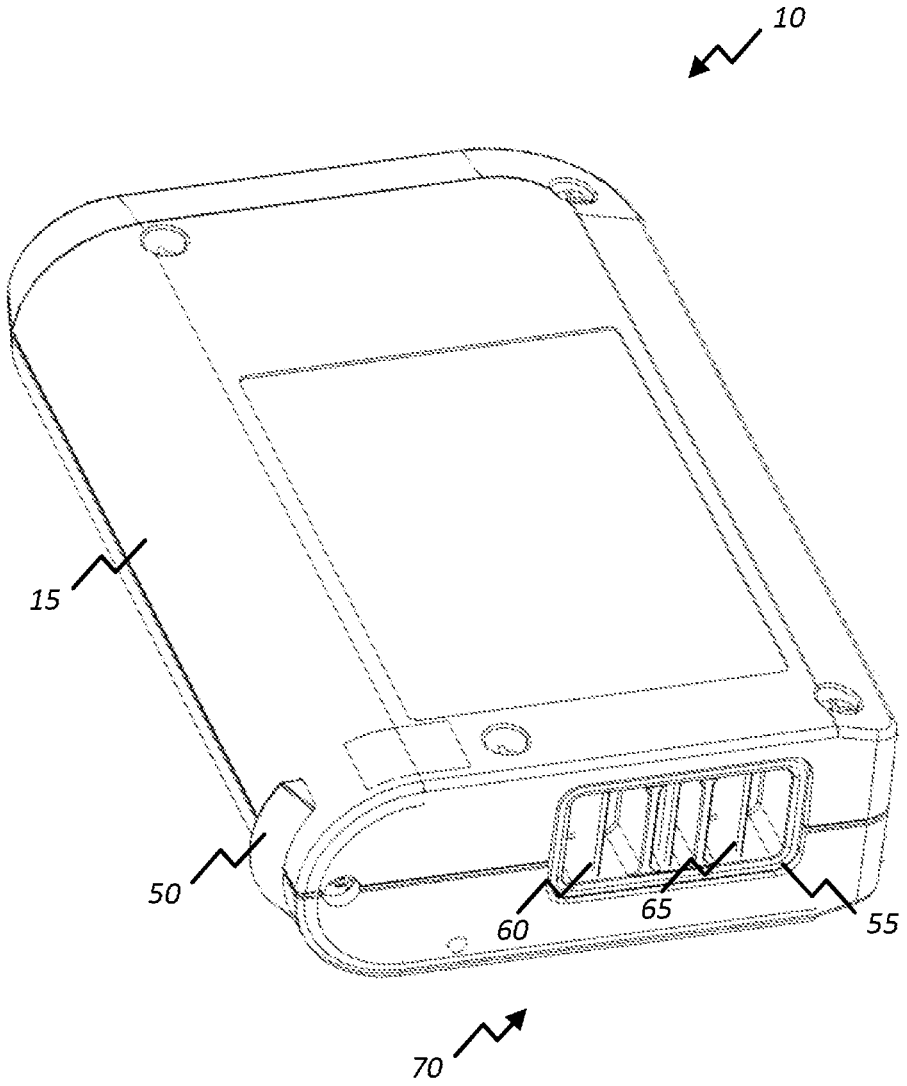
FIG. 2 illustrates the battery pack.
Figure 4:
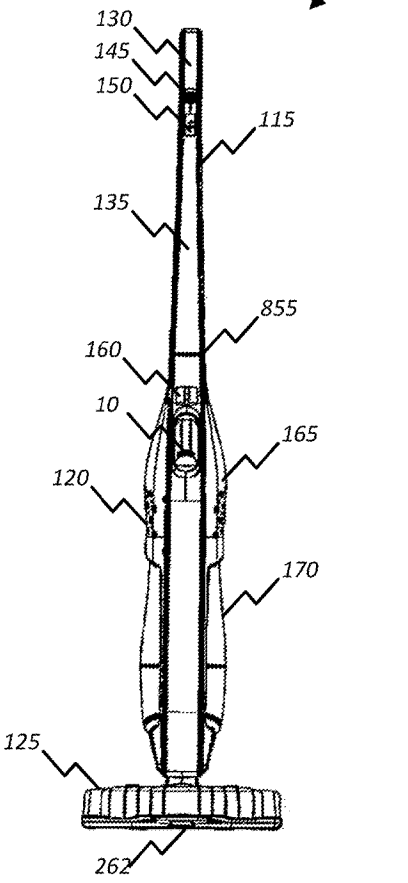
FIG. 4 illustrates the cleaning system.
Figure 3:
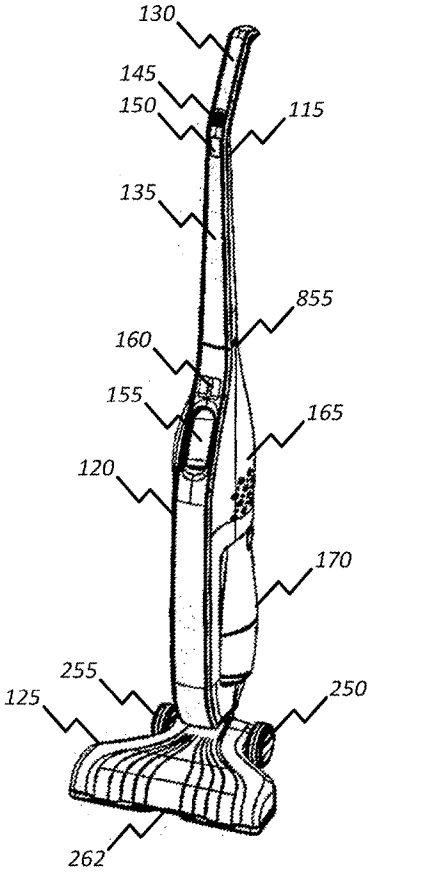
FIG. 3 illustrates a cleaning system powered by the battery pack of FIG. 1.
Figure 6:
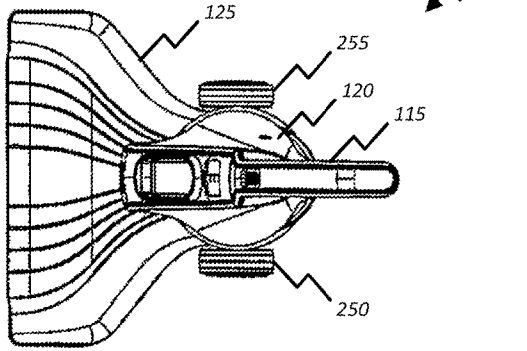
FIG. 6 illustrates the cleaning system.
Figure 7:
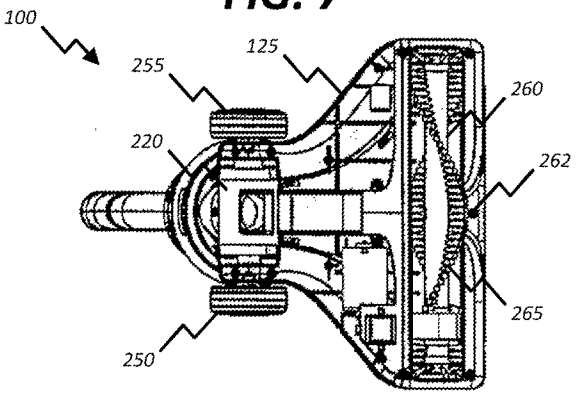
FIG. 7 illustrates the cleaning system.

FIGS. 1 and 2 illustrate a battery pack 10. The battery pack 10 has a lithium-cobalt ("Li—Co"), lithium-magnanese ("Li—Mn"), Li—Mn spinel, or other suitable lithium or lithium-based chemistry. Alternatively, the battery pack has, for example, a nickel-metal hydride ("NiMH") or nickel-cadmium ("NiCd") based chemistry. The battery pack 10 has a nominal voltage rating of 4V, 8V, 12V, 16V, 18V, 20V, 24V, 36V, 48V, etc., or other voltage rating therebetween or greater than 48V. Battery cells within the battery pack 10 have capacity ratings of, for example, 1.2 Ah, 1.3 Ah, 1.4 Ah, 2.0 Ah, 2.4 Ah, 2.6 Ah, 3.0 Ah, etc. The individual cell capacity ratings are combined to produce a total battery pack capacity rating, which is based both on the capacity ratings of the individual cells and the number of cells in the battery pack 10. In some constructions, the individual battery cells have energy densities of 0.348 Wh/cm3, although other energy densities are used in other constructions. The battery pack 10 is able to provide an overall energy density of, for example, at least 0.084 Wh/cm3.

The battery pack 10 includes a housing 15 formed of a first half or shell 20 and a second half or shell 25. The first and second shells 20, 25 are coupled to one another using, for example, screws 30 or other suitable fastening devices or materials. A lever 35 is pivotally mounted to the housing 15, and enables the removal of the battery pack 10 from a device. A first end 40 of the lever 35 is pulled to unlatch or eject the battery pack 10 from the device. In some constructions, the first end 40 is formed as a raised portion adjacent to a recess 45. The raised portion of the first end 40 and the recess 45 are sized to receive, for example, a user's finger or another object to pivot the lever 35.

A push rod is movably mounted to the housing 15, and is configured to be axially moved by the pivoting motion of the lever 35. A latch 50 is extendable, movably mounted to the housing 55, and configured to be moved from a first position (e.g., a latched position) to a second position (e.g., an unlatched position) by the movement of the push rod, via the pivoting movement of the lever 35. While in the latched position, the latch 50 securely couples the battery pack 10 to the device. The movement of the latch 50 from the first position to the second position allows the battery pack 10 to be removed from the device. In the illustrated construction, a single latch is provided. In other constructions, additional latches are provided within a battery pack.

The battery pack 10 further includes an electrical interface 55. Electrical communication to and from the battery pack 10 are made through the electrical interface 55, which is slightly recessed within the housing 15. The electrical interface 55 includes electrical connections 60 and 65, which are located at a bottom side 70 of the battery pack 10.

FIGS. 3-7 illustrate a cleaning system 100 powered by the battery pack 10. The cleaning system 100 is illustrated as an upright vacuum cleaner, however, in other constructions, the cleaning system 100 can be a stick-type vacuum, a handheld vacuum, a carpet cleaner, or the like. The cleaning system 100 includes a handle portion 115, a body portion 120, and a base portion 125. In some constructions, the cleaning system 100 further includes a hose or other attachments.

Figure 5:
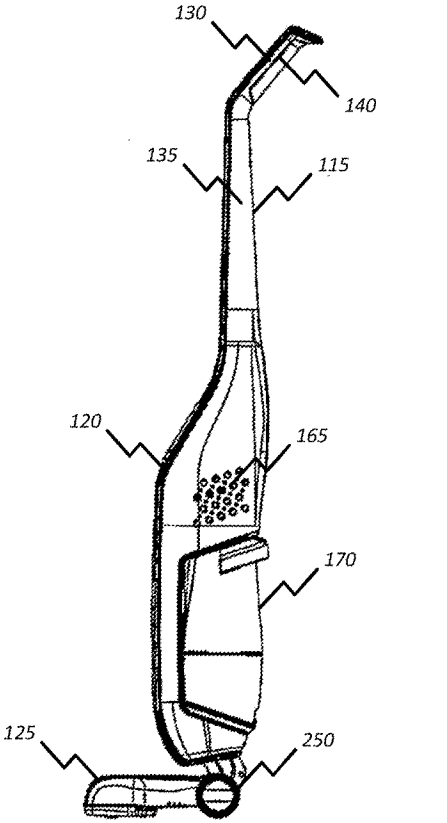
FIG. 5 illustrates the cleaning system.

The handle portion 115 includes a first section 130 and a second section 135. The first section 130 is oblique with respect to the second section 135 and includes a grip portion 140 (FIG. 5). The grip 140 includes one or more user-controlled switches 145. In one construction, the user-controlled switch 145 is a three-position switch. In another construction, there are multiple two-position user-controlled switches 145. The second section 135 includes, among other things, a plurality of indicators 150 for providing indications to a user related to the operational mode of the cleaning system 100. In some constructions, the plurality of indicators 150 are light emitting diodes (LEDs).

In some constructions, the handle portion 115 is removably coupled to the body portion 120. For example, for storage or transport purposes, the handle portion 115 is detachable from the body portion 120. In some constructions, the handle portion 115 is coupled and secured to the body portion 120 via friction only. In other constructions, the handle portion 115 is coupled and secured to the body portion 120 via a screw or other suitable fastening device. The handle portion 115 further includes a plurality of electrical connectors located at an interface between the handle portion 115 and the body portion 120. The electrical connectors electrically connect the handle portion 115 to the body portion 120, so that electrical signals related to the operation of the cleaning system 100 can be sent from the handle portion 115 to the body portion 120 to control, for example, a motor/fan assembly.

The body portion 120 includes a battery receptacle 155, a fuel gauge 160, a motor/fan assembly 165, and a refuse chamber 170. In some constructions, the body portion 120 can further include a cyclonic separator. The battery receptacle 155 receives the battery pack 10. The battery receptacle 155 includes a plurality of electrical connectors for electrically connecting the battery pack 10 to the cleaning system 100. The fuel gauge 160 is configured to provide an indication to the user of the voltage or charge level of the battery pack 10 inserted into the battery receptacle 155. Although shown as being located above the battery receptacle 155 on the body portion 120, in other constructions, the fuel gauge 160 can be located on the handle portion 115 or the base portion 125.

The motor/fan assembly 165 is positioned below the battery receptacle 155. Such an arrangement between the battery receptacle 155 and the motor/fan assembly 165 is advantageous because airflow from the motor/fan assembly 165 provides cooling to the battery pack 10 when placed within the battery receptacle 155. The motor/assembly includes a suction motor 166 (FIG. 9) and a rotor, such as an impeller or a fan. In some constructions, the suction motor 166 is a brushless direct-current ("BLDC") motor. In other constructions, the suction motor 166 can be a variety of other types of motors, including but not limited to, a brush DC motor, a stepper motor, a synchronous motor, or other DC or AC motors.

The refuse chamber 170 is positioned below the motor/fan assembly 165, and is removably coupled to the body portion 120. In the illustrated construction, the refuse chamber 170 is bagless and includes a latching mechanism, which secures the refuse chamber 170 to the cleaning system 100. The refuse chamber 170 further includes an inlet for receiving refuse. In other constructions, the refuse chamber 170 includes disposable bags for collecting the refuse.

Figure 8:
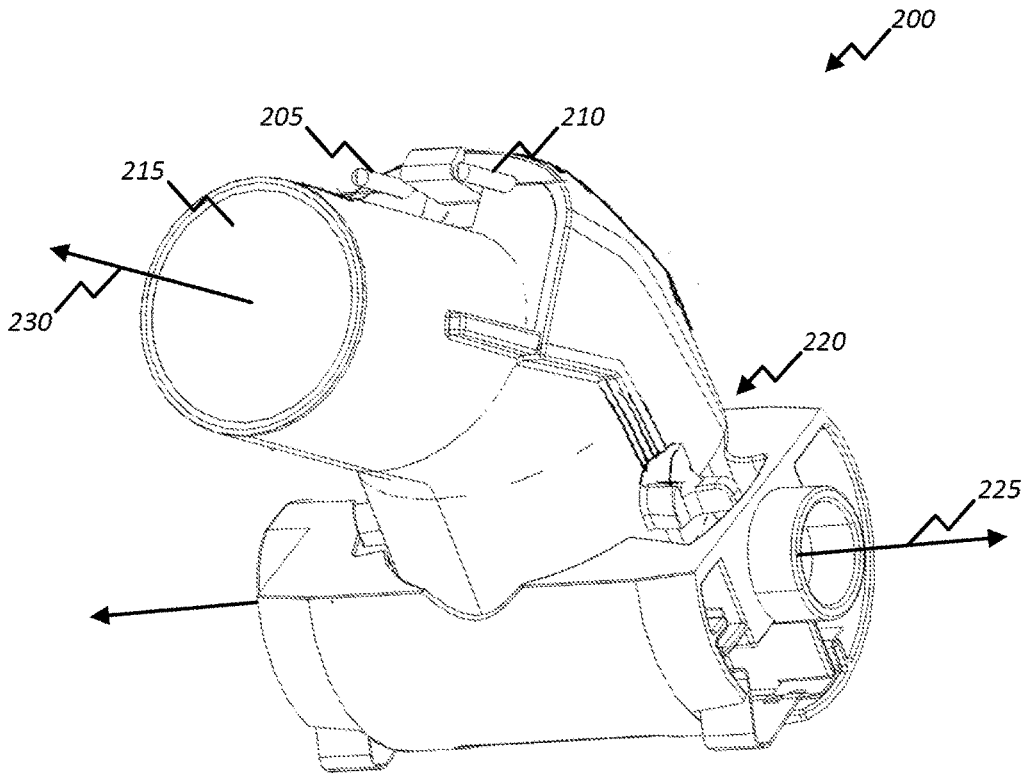
FIG. 8 illustrates an interface of the cleaning system.

A lower end of the body portion 120 includes an interface for attaching the body portion 120 to the base portion 125. The base portion 125 includes a corresponding interface 200 (FIG. 8) for attaching to the body portion 120. In one construction, the interface 200 includes, among other things, two terminals 205, 210, an outlet 215, and a pivot joint 220. The two terminals 205, 210, provide power to the base portion 125 from the battery pack 10. The outlet 215 provides refuse to the body portion 120 from the base portion 125. The pivot joint 220 allows the handle portion 115 and body portion 120 to pivot with respect to the base portion 125. For example, the pivot joint 220 allows for pivotal movement of the handle portion 115 and body portion 120 about a first axis 225 parallel to a cleaning surface. Pivotal movement about the first axis 225 allows the handle portion 115 and body portion 120 to be moved from a position approximately perpendicular to the base portion 125 to a position approximately parallel to the ground. For example, the handle portion 115 and body portion 120 are able to be moved through an angle of between approximately 0.0° and approximately 90.0° with respect to the base portion 125. In other constructions, the handle portion 115 and body portion 120 are pivotable through larger angles.

The handle portion 115 and body portion 120 are also pivotable along a second axis 230. The second axis 230 is approximately perpendicular to the first axis 225 and is approximately parallel to the handle portion 115 and body portion 120. Pivotal movement about the second axis 230 provides additional control and maneuverability of the cleaning system 100. In other constructions, a ball joint is employed rather than the pivot joint 220.

Figure 9:
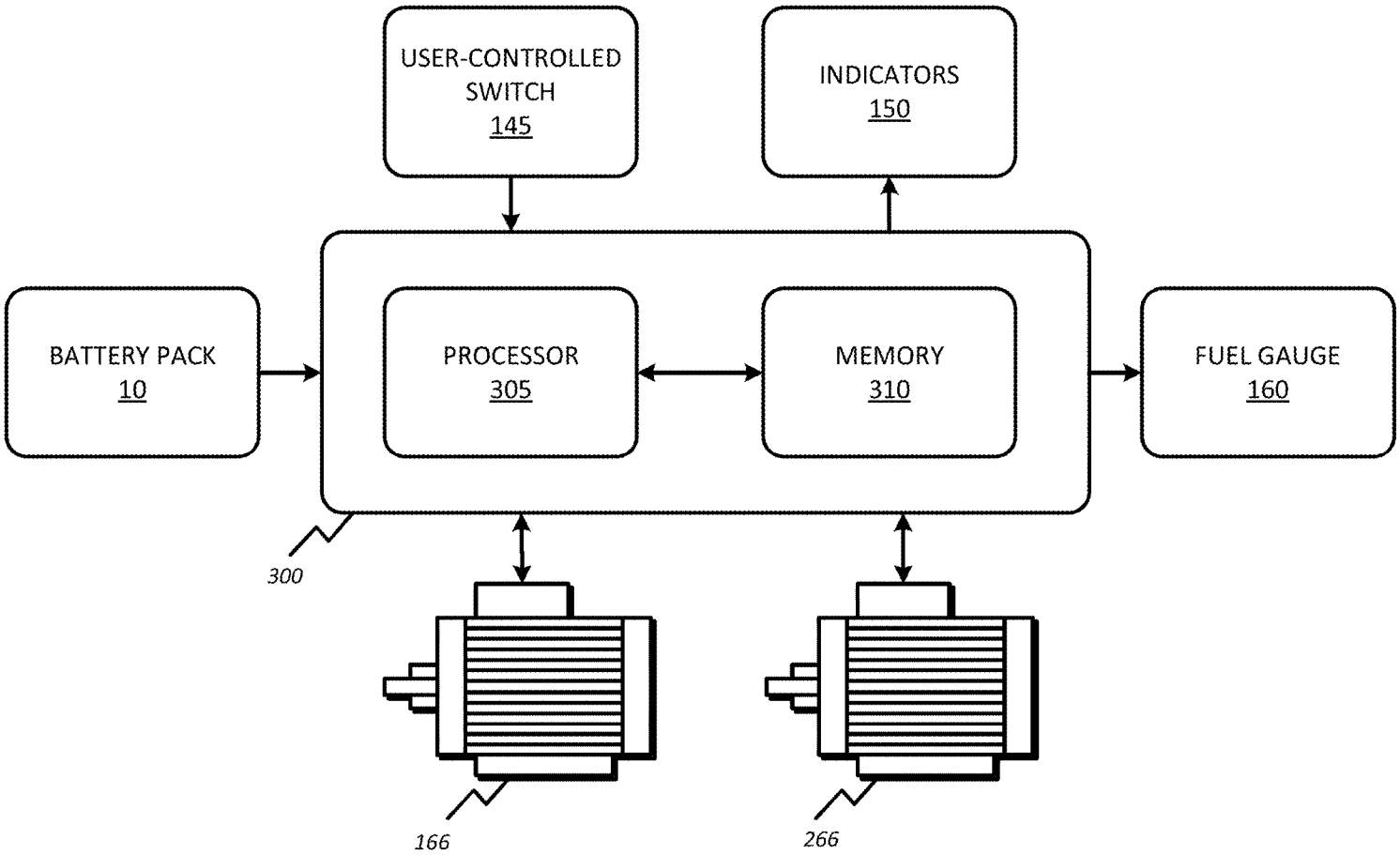
FIG. 9 illustrates a controller of the cleaning system.

The base portion 125 includes a first wheel 250, a second wheel 255, a suction inlet 260, an agitator, such as a brush 265, and a brush motor 266 (FIG. 9). The first and second wheels 250, 255 are coupled to the base portion 125 along the first axis 225. The suction inlet 260 allows refuse to enter into the cleaning system 100. In some constructions, the suction inlet 260 further includes an aperture or notch 262 which allows larger objects to enter the suction inlet 260 without requiring the user to lift the cleaning system 100.

The brush motor 266 rotates the brush 265. In some constructions, the brush motor 266 is a brushless direct-current ("BLDC") motor operable at multiple speeds, for example, a high-speed and a low-speed. In other constructions, the brush motor 266 can be a variety of other types of motors, including but not limited to, a brush DC motor, a stepper motor, a synchronous motor, or other DC or AC motors.

The cleaning system 100 further includes a controller 300, shown in FIG. 9. The controller 300 is electrically and/or communicatively connected to a variety of modules or components of the cleaning system 100. For example, the controller 300 is connected to the user-controlled switch 145, indicators 150, the fuel gauge 160, the suction motor 166, and the brush motor 266. The controller 300 receives power from the battery pack 10. The controller 300 includes combinations of hardware and software that are operable to, among other things, control the operation of the cleaning system 100.

In some constructions, the controller 300 includes a plurality of electrical and electronic components that provide power, operational control, and protection to the components and modules within the controller 300 and cleaning system 100. For example, the controller 300 includes, among other things, a processor 305 (e.g., a microprocessor, a microcontroller, or another suitable programmable device) and a memory 310. In some constructions, the controller 300 is implemented partially or entirely on a semiconductor (e.g., a field-programmable gate array ["FPGA"] semiconductor) chip.

The memory 310 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processor unit 305 is connected to the memory 310 and executes software instructions that are capable of being stored in a RAM of the memory 310 (e.g., during execution), a ROM of the memory 310 (e.g., on a generally permanent basis), or another non-transitory computer readable medium such as another memory or a disc. Software included in the implementation of the cleaning system 100 can be stored in the memory 310 of the controller 300. The software includes, for example, firmware, one or more applications, program data, filters, rules, one or more program modules, and other executable instructions. The controller 300 is configured to retrieve from memory and execute, among other things, instructions related to the control processes and methods described herein. In other constructions, the controller 300 includes additional, fewer, or different components.

The controller 300 calculates, or determines, the voltage of the battery pack 10. The controller 300 then outputs a signal indicative of the voltage, or charge level, to the fuel gauge 160 to be displayed to the user. The controller 300 also receives signals from the user-controlled switch 145. In some constructions, the user-controlled switch 145 completes a circuit or circuits, which results in signals being sent to the controller 300.

Figure 10:
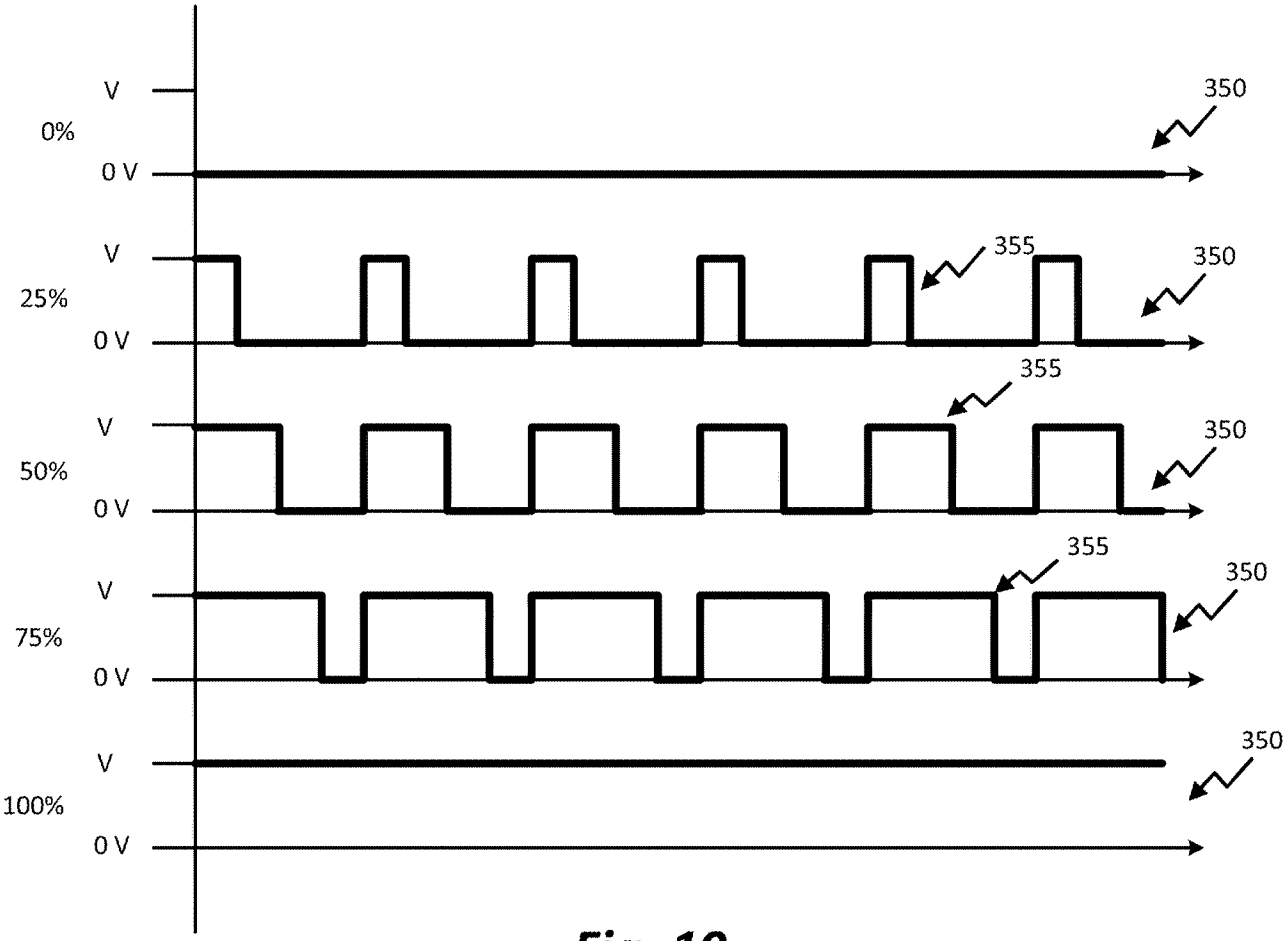
FIG. 10 illustrates examples of pulse-width modulated signals.

The controller 300 operates the suction motor 166, and the brush motor 266 by use of pulse-width modulated ("PWM") signals. FIG. 10 illustrates examples of PWM signals 350 used to control the suction motor 166 and brush motor 266. The PWM signal 350 includes a duty cycle 355. Control of the suction motor 166 and brush motor 266 is achieved by modifying the duty cycle 355 of the respective PWM signals 350. The duty cycle 355 of the PWM signals 350 is controlled in response to at least one of a signal received from the user-controlled switch 145 and the voltage of the battery pack 10. FIG. 10 illustrates the PWM signal 350 having a duty cycle 355 of 0%, 25%, 50%, 75%, and 100%. The PWM signal 350 can have a duty cycle 355 ranging from 0% to 100%.

The suction motor 166 is controlled such that the speed of the suction motor 166 remains substantially constant. The brush motor 266 is controlled such that the speed of the brush motor 266 remains at a substantially constant low-speed or a substantially constant high-speed. The constant speeds are achieved by modifying the duty cycle of the respective PWM signals to the suction motor 166 and brush motor 266. The duty cycles are modified based on the voltage of the battery pack 10. For example, the controller 300 calculates, or determines, the voltage of the battery pack 10, as discussed above. As the voltage of the battery pack 10 decreases during use of the cleaning system 100 the voltage provided to the suction motor 166 and brush motor 266 is decreased. Therefore, in order to maintain the constant speed of the suction motor 166 and brush motor 266, the duty cycles of the respective PWM signals will be increased as the voltage of the battery pack 10 decreases. The controller 300 continually determines the voltage of the battery pack 10 and modifies the duty cycles of the respective PWM signals based on the voltage of the battery pack 10 in order to keep the suction motor 166 and brush motor 266 operating at the respective substantially constant speeds.

As discussed above, the brush motor 266 can be maintained at a constant low-speed or a constant high-speed. When the user-controlled switch 145 is set to a "NORMAL OPERATION" the controller 300 controls the suction motor 166 at the constant speed and the brush motor 266 at the high-speed (e.g., with a PWM signal having a 60% duty cycle when the battery pack 10 is at full-charge). When the user-controlled switch 145 is set to "QUIET OPERATION" the controller 300 controls the suction motor 155 at the constant speed and the brush motor 266 at the low-speed (e.g., by decreasing the duty cycle of the PWM signal to the brush motor 266). In one construction, the indicators 150 are used to indicate to the user that the brush motor 266 is operating at the low-speed or the high-speed.

In other constructions the suction motor 166 operates at a high-speed and a low-speed. In this construction, during "NORMAL OPERATION," the suction motor 166 operates at the low-speed. During "QUIET OPERATION," the brush motor 266 is decreased to the low-speed and the suction motor 166 is increased to the high-speed.

In some constructions, the controller 300 can determine if a fault occurs within the cleaning system 100. Faults include, for example, the brush 265 being prohibited from rotating or the suction inlet 260 becoming clogged. In one construction, the controller 300 determines a fault by monitoring the current drawn by the suction motor 166 and the brush motor 266. If the current drawn by the suction motor 166 or the brush motor 266 exceeds a predetermined threshold, the controller 300 will turn off the suction motor 166 and brush motor 266 and indicate a fault to the user via the indicators 150.

Figure 11:
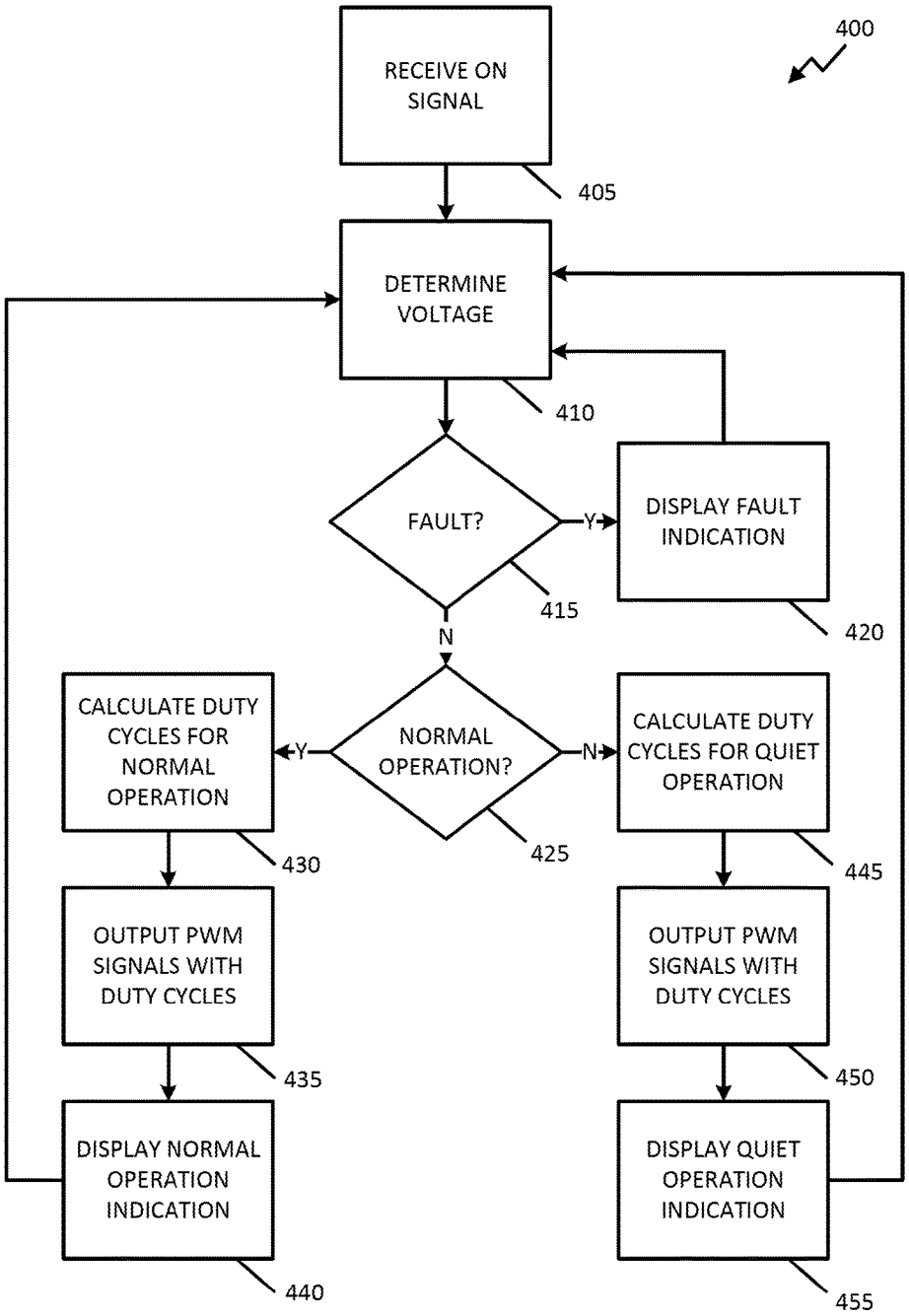
FIG. 11 is a flow chart illustrating an operation of the cleaning system.

FIG. 11 illustrates a flow chart of an operation 400 of the cleaning system 100. The controller 300 receives an "ON" signal from the user-controlled switch 145 (Step 405). The controller 300 determines the voltage of the battery pack 10 (Step 410). The controller determines if there is a fault present (Step 415). If there is a fault, the controller 300 indicates a fault to the user using the indicators 150(Step 420). If there is not a fault, the controller 300 determines if the user-controlled switch 145 is set to "NORMAL OPERATION" (Step 425). If the user-controlled switch 145 is set to "NORMAL OPERATION," the controller 300 calculates a suction duty cycle and a normal brush duty cycle based on the voltage of the battery pack 10 (Step 430). The controller 300 outputs a first PWM signal to the suction motor 166, the first PWM signal having the calculated suction duty cycle and a second PWM signal to the brush motor 266, the second PWM signal having the calculated normal brush duty cycle (Step 435). The controller 300 indicates to the user, using the indicators 150, that the cleaning system 100 is operating in the "NORMAL OPERATION" mode (Step 440). The controller 300 reverts back to Step 410. If the user-controlled switch is not set to "NORMAL OPERATION" it is set to "QUIET OPERATION," therefore the controller 300 calculates a suction duty cycle and a quiet brush duty cycle based on the voltage of the battery pack 10 (Step 445). The controller 300 outputs the first PWM signal to the suction motor 166, the first PWM signal having the calculated suction duty cycle and the second PWM signal to the brush motor 266, the second PWM signal having the calculated quiet brush duty cycle (Step 450). The controller 300 indicates to the user, using the indicators 150, that the cleaning system 100 is operating in the "QUIET OPERATION" mode (Step 455). The controller 300 reverts back to Step 410.

Thus, the invention provides, among other things, a cleaning system having a suction motor and a brush motor. Various features and advantages of the invention are set forth in the following claims.

What is claimed is:

1. A cleaning system comprising:
- a rotor;
- an agitator;
- a rechargeable battery;
- a suction motor receiving power from the rechargeable battery, the suction motor coupled to the rotor;
- a brush motor receiving power from the rechargeable battery, the brush motor coupled to the agitator;
- a user-controlled switch configured to generate a user-activated signal in response to user manipulation; and
- a controller configured to
  - output a first pulse-width modulated signal at a first duty cycle to control the suction motor,
  - output a second pulse-width modulated signal at a second duty cycle to control the brush motor at a first speed in a first direction,
  - receive the user-activated signal,
  - upon receiving the user-activated signal, maintain output of the first pulse-width modulated signal at the first duty cycle while outputting the second pulse-width modulated signal at a third duty cycle to control the brush motor at a second speed in the first direction, wherein the second duty cycle and the third duty cycle are different; and
- and indicator indicating that the brush motor is operating at least one selected from the group consisting of the first speed and second speed.

2. The cleaning system of claim 1, wherein at least one selected from the group consisting of the first duty cycle, the second duty cycle, and the third duty cycle are modified based on a voltage of the rechargeable battery.

3. The cleaning system of claim 1, wherein the first speed and the second speed are equal.

4. The cleaning system of claim 1, wherein the rechargeable battery has a housing and at least two cells within the housing.

5. The cleaning system of claim 1, further including a fuel gauge, wherein the fuel gauge indicates a voltage of the rechargeable battery.

6. The cleaning system of claim 1, wherein the cleaning system is an upright vacuum.

7. The cleaning system of claim 1, wherein at least one selected from the group consisting of the suction motor and brush motor is a brushless direct-current motor.

8. The cleaning system of claim 1, wherein the rechargeable battery is selectively coupled to the cleaning system.

9. The cleaning system of claim 1, wherein the controller is further configured to indicate to the user via an indicator that a fault has occurred.

10. The cleaning system of claim 1, wherein the controller is further configured to output the first pulse-width modulated signal having a fourth duty cycle to the suction motor after the controller outputs the second pulse-width modulated signal at the third duty cycle.

11. A cleaning system comprising:
- a rotor;
- an agitator;
- a rechargeable battery;
- a suction motor receiving power from the rechargeable battery, the suction motor coupled to the rotor;
- a brush motor receiving power from the rechargeable battery, the brush motor coupled to the agitator;
- a user-controlled switch configured to generate a user-activated signal in response to user manipulation; and
- a controller configured to
  - output a first pulse-width modulated signal at a first duty cycle to control the suction motor,
  - output a second pulse-width modulated signal at a second duty cycle to control the brush motor at a first speed in a first direction,
  - receive the user-activated signal,
  - upon receiving the user-activated signal, maintain output of the first pulse-width modulated signal at the first duty cycle while outputting the second pulse-width modulated signal at a third duty cycle to control the brush motor at a second speed in the first direction, wherein the second duty cycle and the third duty cycle are different; and
  - wherein the controller is further configured to indicate to the user via an indicator that a fault has occurred.

12. The cleaning system of claim 11, wherein at least one selected from the group consisting of the first duty cycle, the second duty cycle, and the third duty cycle are modified based on a voltage of the rechargeable battery.

13. The cleaning system of claim 11, wherein the first speed and the second speed are equal.

14. The cleaning system of claim 11, wherein the rechargeable battery has a housing and at least two cells within the housing.

15. The cleaning system of claim 11, further including a fuel gauge, wherein the fuel gauge indicates a voltage of the rechargeable battery.

16. The cleaning system of claim 11, further including and indicator indicating that the brush motor is operating at least one selected from the group consisting of the first speed and second speed.

17. The cleaning system of claim 11, wherein the cleaning system is an upright vacuum.

18. The cleaning system of claim 11, wherein the rechargeable battery is selectively coupled to the cleaning system.

19. The cleaning system of claim 11, wherein the controller is further configured to output the first pulse-width modulated signal having a fourth duty cycle to the suction motor after the controller outputs the second pulse-width modulated signal at the third duty cycle.

* * * * *